US006220362B1

(12) United States Patent
Roth et al.

(10) Patent No.: US 6,220,362 B1
(45) Date of Patent: Apr. 24, 2001

(54) CONDUIT AND CABLE BYPASS FOR DOWNHOLE TOOLS

(75) Inventors: Brian Roth; Prashant Patel, both of Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/276,338

(22) Filed: Mar. 25, 1999

(51) Int. Cl.[7] ..... E21B 33/047
(52) U.S. Cl. ..... 166/380; 166/65.1
(58) Field of Search ..... 166/65.1, 117.5, 166/380, 382, 313, 387, 50

(56) References Cited

U.S. PATENT DOCUMENTS

| | | | |
|---|---|---|---|
| 2,739,650 | 3/1956 | Hill . | |
| 3,899,631 | 8/1975 | Clark . | |
| 4,019,580 | 4/1977 | Garrett | 166/315 |
| 4,364,432 | 12/1982 | Bass et al. | 166/290 |
| 4,534,414 | 8/1985 | Pringle . | |
| 4,798,243 | 1/1989 | Curington et al. . | |
| 5,184,677 | 2/1993 | Dobscha, et al. . | |
| 5,297,943 | 3/1994 | Martin . | |
| 5,894,896 | 4/1999 | Smith et al. | 175/73 |
| 5,957,209 | 9/1999 | Burleson et al. | 166/380 |

*Primary Examiner*—Frank Tsay
(74) *Attorney, Agent, or Firm*—Duane, Morris & Heckscher LLP

(57) ABSTRACT

A structure and technique is disclosed to allow passing control lines, conduits or cables of all sorts through a downhole tool. The assembly provides for passage of the conduit or cable through and into the bore of the downhole tool, protected by an internal carrier. The end connections are assembled without any twisting force applied to the cable or conduit. The end connections resist torque. A jam nut on either end provides one seal, and internal seals are used against the mandrel of the downhole tool to further provide pressure isolation where the cable or conduit enters the tool body or exits. Tensile loads are passed through the tool body rather than the cable or conduit. There is complete pressure isolation between the conduit and both the tubing and the annulus.

21 Claims, 5 Drawing Sheets

CONDUIT AND CABLE BYPASS FOR DOWNHOLE TOOLS

FIELD OF THE INVENTION

The field of this invention relates to extending conduits or cables through one or more downhole tools, particularly where the tools, when actuated, engage an interior wall of a casing or tubular.

BACKGROUND OF THE INVENTION

In many downhole applications, it is necessary to run small-diameter conduits or various signal, power, or fiber optic cables downhole for a variety of control and measurement purposes. Frequently, conduits or cables of whatever type must extend past such structures as packers which, when set, completely isolate one portion of the wellbore from another. Various techniques have been used to get conduits and cables past the packing element and setting mechanism of such downhole tools as packers. In some designs, the body of the packer is made additionally thick so that a parallel path can be drilled through the body. This parallel path can literally allow a cable or conduit to pass therethrough with seals on top or bottom. Alternatively, the conduit can be broken at either end of the passage and the passage itself becomes an extension of the conduit. However, this design has the unique disadvantage in that space is limited downhole. Thus, the provision of the additional path or paths to accommodate cables or conduits or both necessarily results in a decreasing available diameter for the main bore through the packer. Thus, a reduction in the I.D. of the bore of the packer, or other downhole tool, limits its usefulness because it restricts flow as well as making it difficult, if not impossible, to pass tools through it to perform procedures further downhole below the tool. Another difficulty with this design is that there are many components that make up the body of the downhole tool, such as a packer. All the components have to be assembled so that the bore in each piece is in alignment so that the conduit or cable can pass through.

Another alternative is to place connectors in the conduit above and below a parallel path through the body of the downhole tool such that the conduit, for example, does not literally pass through the parallel path but terminates at an upper end with a connector and resumes at the lower end of the parallel path with another connector. This has the disadvantage of introducing more connections with potential leakpaths. Additionally, in some applications, thermal loads can become an issue which require coiled sections of the conduit around the downhole tool to compensate for differential expansion.

The use of parallel paths in many cases requires an eccentric design where the main bore through the downhole tool, such as the packer, is off-center to allow room for the various parallel paths for the control lines or cables. Additionally, very long bores under the element of a packer through its body are expensive to fabricate.

In other designs, rotation is required to make up the end connections on at least one end of the downhole tool, with the tubing or cable extending through the tool. This requires the allocation of sufficient slack in the cable or tubing to allow for final make-up. Additionally, in those prior designs, the end connections would not necessarily be designed for torque resistance. Thus, applied torque could stress the line or cable, causing a cut or leak. One such prior design, which breaks the control line and provides a parallel passage while providing no torque resistance on one end where the control line is connected, is the FHL Packer provided by Baker Oil Tools.

Accordingly, one of the objectives of the present invention is to provide an ability to feed the control line or cable through a downhole tool without twisting. Another feature is to minimize orientation issues in feeding the cable or control line through the downhole tool. Another objective is to provide torque resistance which, at the same time, can ease alignment so that the cable or conduit can be simply fed through the downhole tool. Another objective is to provide protection for cables or control lines as they pass through the body of the tool without having to go through a separate and discrete path from the main wellbore, which would in turn reduce the available diameter for the bore through the tool. Another objective is to be able to provide a seal around the cable or conduits. Such seals could also be metal-to-metal, if necessary. Yet another objective is easy passage of single or multiple control lines or cables and increased reliability of objects passing in a conduit since the conduit can be continuous. These and other objectives will be more readily understood by those skilled in the art from a review of the preferred embodiment of the invention described below.

SUMMARY OF THE INVENTION

A structure and technique is disclosed to allow passing control lines, conduits or cables of all sorts through a downhole tool. The assembly provides for passage of the conduit or cable through and into the bore of the downhole tool, protected by an internal carrier. The end connections are assembled without any twisting force applied to the cable or conduit. The end connections resist torque. A jam nut on either end provides one seal, and internal seals are used against the mandrel of the downhole tool to further provide pressure isolation where the cable or conduit enters the tool body or exits. Tensile loads are passed through the tool body rather than the cable or conduit. There is complete pressure isolation between the conduit and both the tubing and the annulus.

DETAILED DESCRIPTION OF THE PREFERRED EMBODIMENT

Figure 1A:
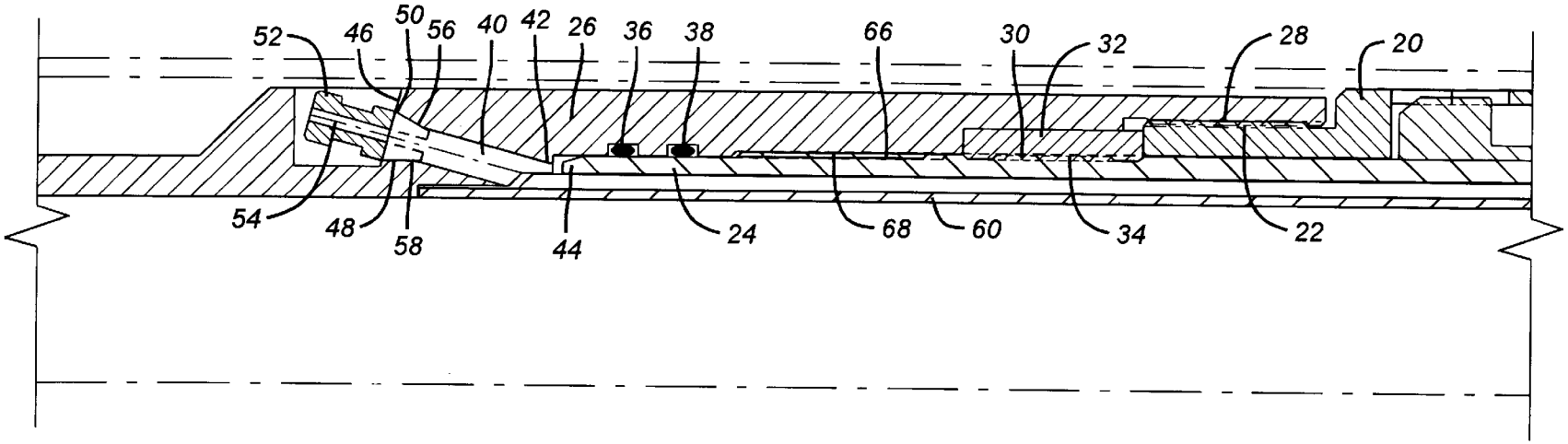
FIGS. 1*a–g* show a sectional elevation, illustrating the present invention applied to a downhole packer.
Figure 1E:
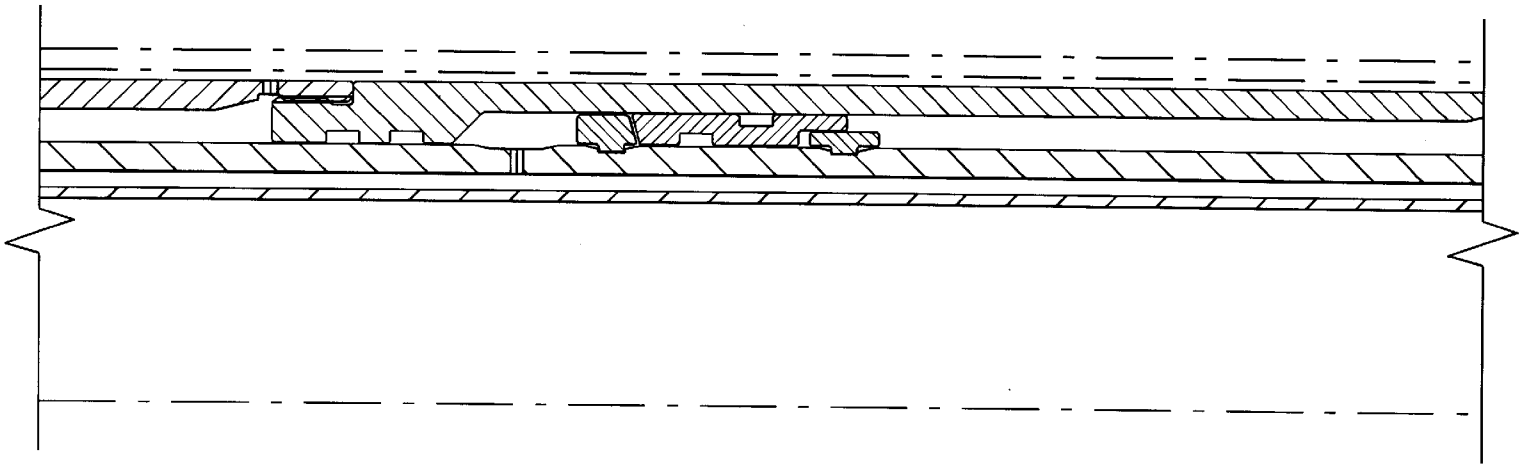
Figure 1B:
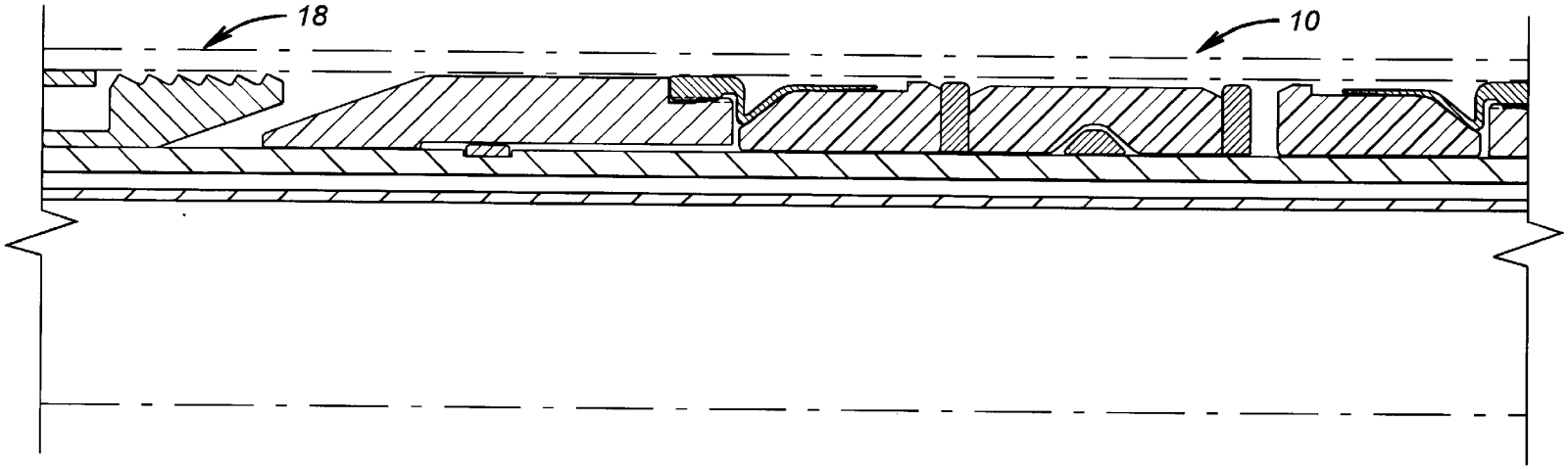
Figure 1F:
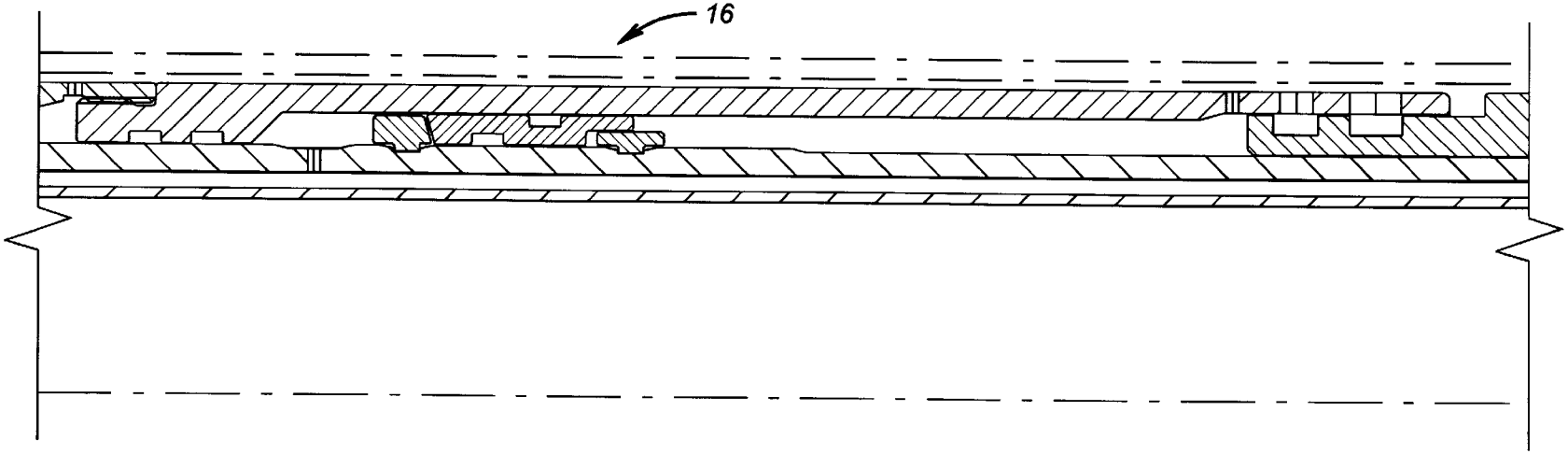
Figure 1C:
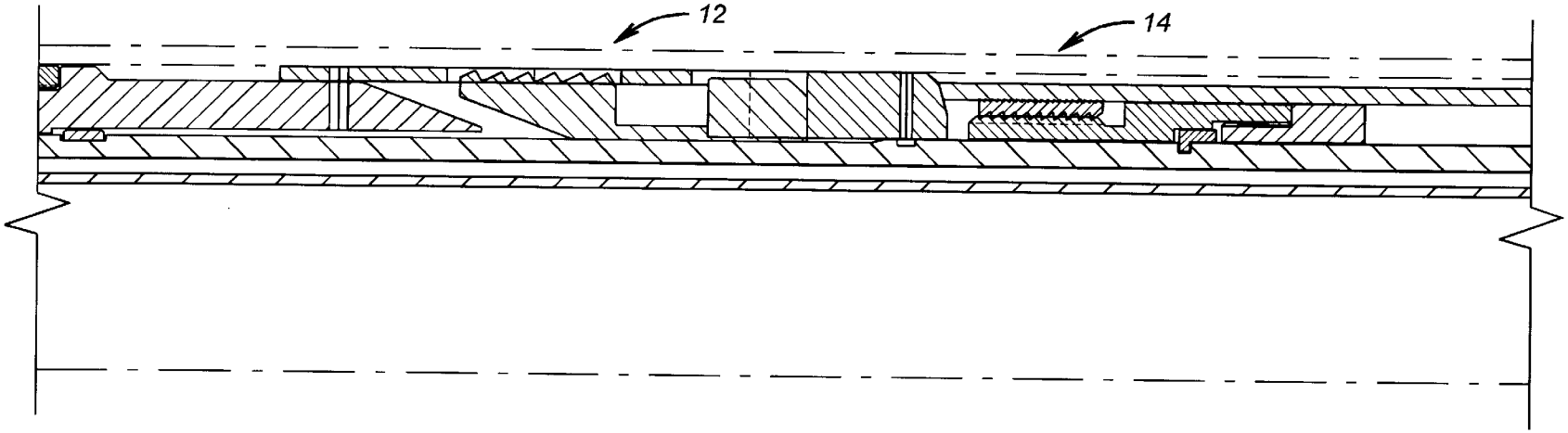

FIGS. 1*a–g* illustrate a packer of known construction insofar as it relates to the sealing assembly 10, the lower slip assembly 12, the locking assembly 14, and the setting assembly 16. Although a packer is illustrated, other types of downhole tools can be used with the components described for this invention.

The upper slip assembly 18 comprises an upper slip cage 20, which further comprises a thread 22. A mandrel 24 extends from FIG. 1*a* through FIG. 1*g*. A top sub 26 fits over mandrel 24 and has a thread 28 to mate up with thread 22 on upper slip cage 20. The mandrel 24 has an external thread 30. A split ring 32 has an internal thread 34 which mates with thread 30 on mandrel 24. Top sub 26 has a pair of seal rings 36 and 38 which seal between the top sub 26 and the mandrel 24. Top sub 26 has a passage 40 which has an end 42 internally adjacent end 44 of mandrel 24. The other end of passage 40 is external at surface 46. There is a thread 48 at end 50 of passage 40. A jam nut 52 is designed to go over a conduit or cable 64 which passes therethrough in a passage 54. Conduit as used in this application is intended to encompass all forms of conveyances for signal or power downhole, including but not limited to tubular structures, cable of any type, such as electrical or fiber optic, for example. The conduit is sealingly inserted through passage 54, and jam nut 52 can be threaded to thread 48 so as to provide a preferably metal-to-metal seal between sloping surfaces 56 and 58. A carrier 60 extends from FIG. 1*a* through FIG. 1*g*. As shown in FIG. 2, the carrier 60 has a series of longitudinal passages such as 62, each of which can accept a conduit 64. Thus, the carrier 60 defines a passage which begins adjacent end 42 of passage 40 and extends through the downhole tool to the assembly shown in FIG. 1*g*, which is the mirror image of the assembly shown in FIG. 1*a*.

Referring now to FIG. 2, it can be seen that the mandrel 24 has a series of splines 66. The top sub 26 also has a series of splines 68 which can be used for alignment of the top sub 26 when bringing it down and over the split ring 32 and the upper slip cage 20. Rotation of the upper slip cage 20 secures the entire assembly because of the engagement of threads 22 and 28. The split ring 32 prevents axial movement of the top sub 26 such that rotating upper slip cage 20 brings it up. By virtue of the engagement of threads 30 and 34, the split ring 32 cannot translate. The top sub 26, when threaded to slip cage 20, holds the split ring 32 against mandrel 24 due to the interengagement of threads 30 and 34 and the overlap of top sub 26 over split ring 32. Thus, upon sufficient rotation of the upper slip cage 20, the top sub 26, which cannot rotate because of the interengagement of splines 66 and 68, translates downwardly until it is drawn against the split ring 32. At that time, a pin 70 (see FIG. 2) is inserted to retain the assembled position.

Figure 1G:
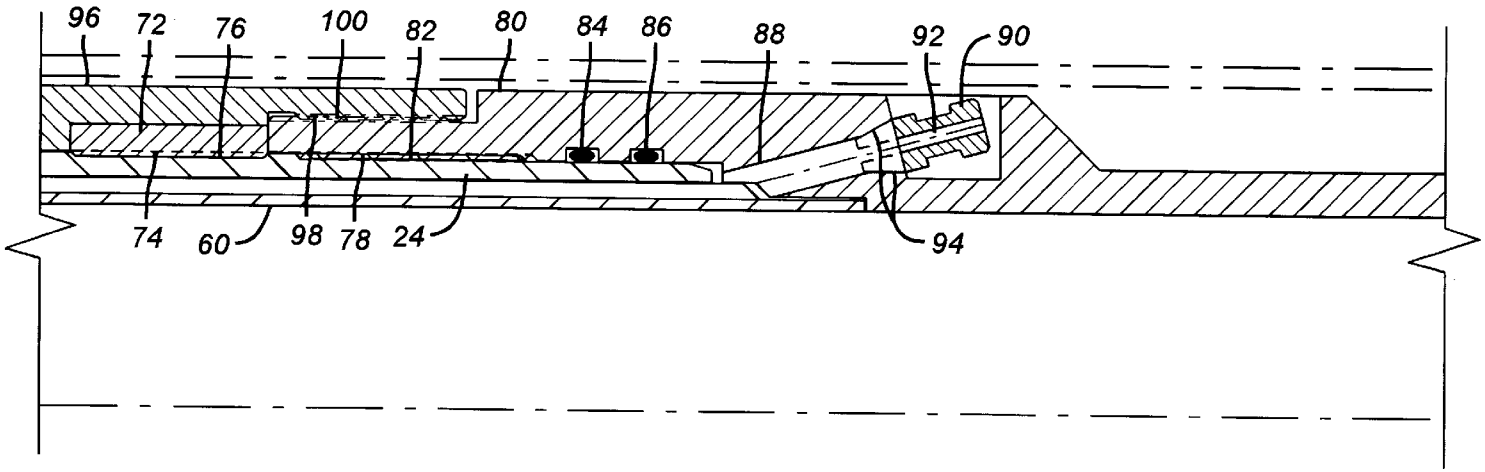
Figure 1D:
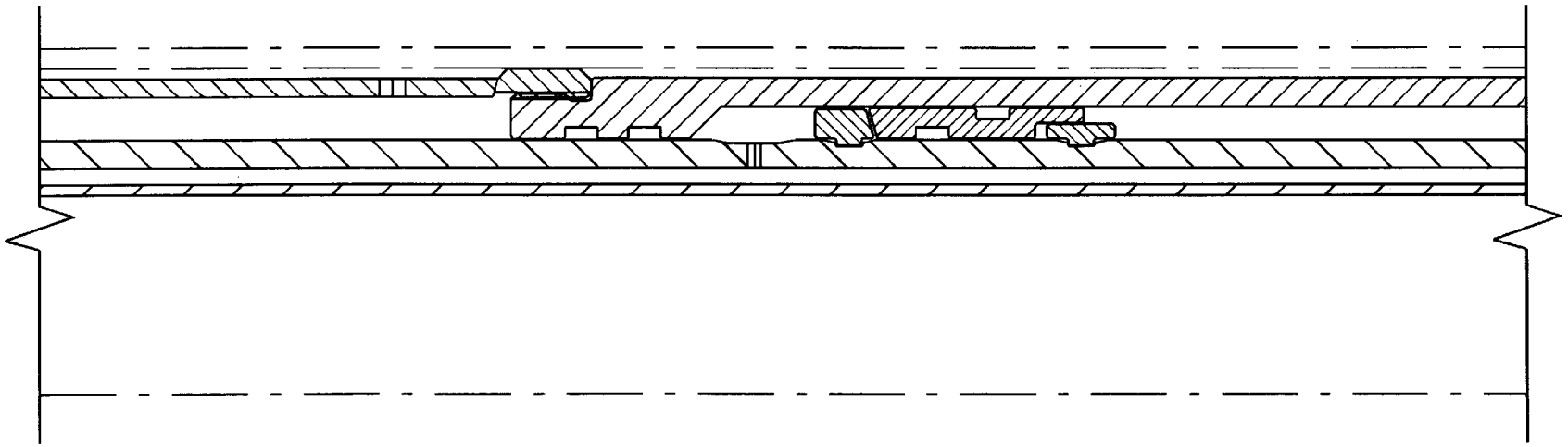
Figure 2:
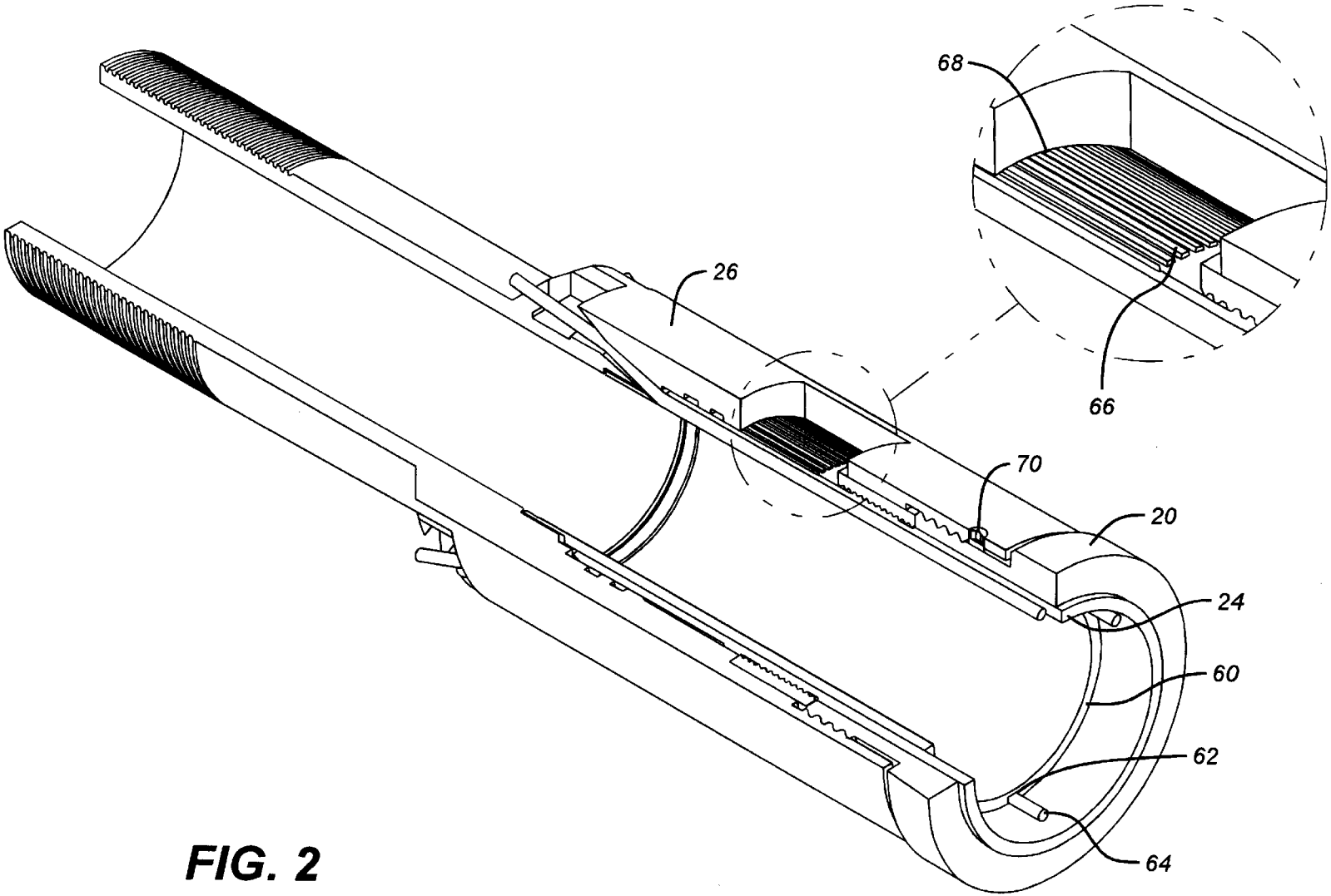
FIG. 2 is a perspective view, part cut-away, of FIG. 1*a*.

Referring now to FIG. 1*g*, the same structure is disposed on the lower end of the downhole tool as was previously described on the upper end. A split ring 72 has a thread 74 which engages a thread 76 on the mandrel 24. Splines 78 on bottom sub 80 engage splines 82 on mandrel 24. Seals 84 and 86, which can be resilient or metallic or other suitable materials for the temperatures and chemicals in the surrounding environment, seal between the bottom sub 80 and the mandrel 24. Bottom sub 80 has at least one passage 88 onto which a jam nut 90 can be secured, which in turn has a passage 92 to allow the extension of a control line or cable (not shown) sealingly therethrough. The jam nut 90 has a tapered sealing surface 94 which helps to provide another seal in the bottom sub 80 to back up seals 84 and 86. In the packer illustrated in FIG. 1, the setting retainer nut 96 has a thread 98 which engages thread 100 on bottom sub 80. With the splines 78 and 82 in engagement, rotation of setting retainer nut 96 will draw up bottom sub 80 against the split ring 72. The carrier 60 extends downwardly into contact with the bottom sub 80.

Those skilled in the art can now see that there are several features to the above-described assembly. First, the splines 66 and 68 allow torque to be transmitted from the top sub 26 to the mandrel 24 without any applied stresses to the conduit 64 which extends through passage 40. The same thing occurs at the lower end where splines 78 and 82 transmit torque from the mandrel 24 to the bottom sub 80 without putting any stresses on any conduits which extend through a given passage 88. Without these splines or equivalent structure which can transmit torque, the conduits which extend through the tool shown in FIG. 1 or any other downhole tool, there exists a possibility for cracking, breaking or tearing due to relative rotational movement of the components.

Similarly, longitudinal stresses are not borne by any conduit which extends from passage 40 and through passage or passages 62 in the carrier 60, over to passage 88 in bottom sub 80. Longitudinal stresses are transmitted through the split rings 32 and 72 due to the interengaging thread pairs 30 and 34 and 74 and 76, respectively. Accordingly, any conduit extending through the downhole tool is further insulated from longitudinal loads which are transmitted into the mandrel 24. The number and size of the various passages 40 can be varied to allow the use of one or more conduits of similar or differing sizes. Clearly, the assemblies at the top and bottom are identical to accommodate the passage of any given number of conduits through the tool.

The carrier 60 has a matching number of passages 62 to accommodate the number of passages 40 and 88 at the top and bottom of the tool, respectively. In that way, the carrier 60 creates protected runs inside the tool so that the passage of equipment through the inside of the tool does not result in any damage to the conduits running through the protected passages 62 in the carrier 60. Sealing around the mandrel 24 occurs, for example, at the top end due to the presence of sealing surface 56 on jam nut 52 engaging sealing surface 58. In the other direction, the seal pair 36 and 38, which can be of a resilient material such as an elastomer, or can be made of a metallic substance or a composite material or other material suitable for the pressures, temperatures and chemical environment, prevents leakage past the threaded connection of threads 22 and 28. A seal that is preferably metal to metal contact can also be used here. The same can be said for the equivalent assembly at the lower end of the tool.

One order of assembly involves extension of the conduit inside the mandrel 24 and through the passage 88 in bottom sub 80. The splines 78 and 82 are aligned after the split ring 72 is placed on the mandrel 24 with threads 74 and 76 in engagement. The bottom sub 80, with the conduits extending through the various respective passages 88, is brought into contact with the setting retainer nut 96, and the setting retainer nut 96 is rotated to make up threads 98 and 100. This draws up the bottom sub 80 until it contacts the split ring 72, fixing split ring 72 in position against the setting retainer nut 96. Thereafter, the jam nuts 90 are made up around each individual conduit in each respective passage 88. It should be noted that at this time, the carrier 60 has not yet been installed. With the conduits now extending through the mandrel 24, the carrier 60 can be slipped in through the upper end after first aligning each of the conduits with their respective passage 62 in carrier 60. In that sense, the conduits act as a guide for the carrier 60, which may be built in one piece or in several pieces for ease of handling and shipping. The carrier structure 60 is then inserted into the mandrel 24 until it bottoms on bottom sub 80 and comes up to where the top sub 26 will ultimately be installed. The conduits, having previously been fed through the passages 40 in top sub 26, are now in their final position. What remains to be done is to bring the top sub 26 down to the upper slip cage 20 to make up thread 28 to thread 22. This is done after the placement of the split ring 32 onto the mandrel 24 so as to allow threads 30 and 34 to engage. The splines 66 and 68 guide the top sub 26 so it cannot rotate. Rotation of the slip cage 20 advances longitudinally the top sub 26 so as to trap the split ring 32. Thereafter, the jam nuts 52 are applied to each of the conduits through a given passage 40 so as to sealingly secure each of the passages 40 and thereby retain the pressure inside the mandrel 24. Seals 36 and 38 also operate to retain the pressure within the mandrel 24. Other sealing systems can be employed as between the mandrel 24 and the top sub 26, or the mandrel 24 and the bottom sub 80 without departing from the spirit of the invention. Other sealing systems can be used for the jam nuts 52 and 90 without departing from the spirit of the invention. Sealing can also be done between the top sub 26, bottom sub 80, and carrier 60 without departing from the spirit of the invention. This means retention of pressure in the carrier 60. Other orders of assembly are possible without departing from the spirit of the invention. The important thing is that the construction is adaptable to any number of downhole tools, not necessarily the known packer illustrated in FIG. 1. The assembly is quick and easy and provides the sealing reliability that is demanded by the end users. No longer are expensive constructions required to provide downhole tool bodies with dedicated passages for conduits. Additionally, since the assembly can occur without having to twist the conduits, additional runs of conduit do not need to be provided to accommodate all the twisting necessary for final assembly as done in the past. Instead, the profile of the downhole tool does not need to be needlessly increased, which is an advantage which can give the maximum bore size available in the mandrel 24. This design also promotes interchangeability for a variety of applications by simply using different carriers 60 in conjunction with similarly matched upper and lower subs so that a host of different combinations of conduits can be accommodated while using the same underlying tool.

The main advantages are fewer joints in conduits since no joints are required to pass by tools, the cables or conduits are protected, the assembly is fast and easy, and torque is transferred at both ends through the mandrel.

The foregoing disclosure and description of the invention are illustrative and explanatory thereof, and various changes in the size, shape and materials, as well as in the details of the illustrated construction, may be made without departing from the spirit of the invention.

What is claimed is:

1. A downhole tool assembly capable of passing at least one conduit therethrough, comprising:

a mandrel having a bore therethrough;

at least one sub sealingly connectible to said mandrel having at least one passage therethrough, said passage in communication with said bore;

a sealing member disposed in said passage for sealing the conduit passing through said passage and thereafter into said bore.

2. The assembly of claim 1, wherein:

said sub is securable to said mandrel without rotation of said sub.

3. The assembly of claim 2, wherein:

said sub is engageable to said mandrel in a manner to prevent relative rotation.

4. The assembly of claim 2, wherein:

said sub is engageable to said mandrel for transmission of longitudinal stresses therebetween.

5. A downhole tool assembly capable of passing at least one conduit therethrough, comprising:

a mandrel at least one sub sealingly connectible to said mandrel having at least one passage therethrough;

a sealing member disposed in said passage for sealing the conduit passing through said passage;

said sub is securable to said mandrel without rotation of said sub;

said sub is engageable to said mandrel in a manner to prevent relative rotation;

said sub is splined to said mandrel for torque transmission therebetween.

6. A downhole tool assembly capable of passing at least one conduit therethrough, comprising:

a mandrel at least one sub sealingly connectible to said mandrel having at least one passage therethrough;

a sealing member disposed in said passage for sealing the conduit passing through said passage;

said sub is securable to said mandrel without rotation of said sub;

said sub is engageable to said mandrel for transmission of longitudinal stresses therebetween;

a travel stop on said mandrel;

a first ring mounted to said mandrel to engage said sub to draw it to said travel stop as said first ring is rotated.

7. The assembly of claim 6, wherein said travel stop further comprises:

a second ring mounted over said mandrel, said second ring having an internal surface to engage an exterior surface of said mandrel for longitudinal locking engagement.

8. The assembly of claim 7, wherein:

said second ring is split to facilitate mounting it to said mandrel;

said second ring and said mandrel further comprising facing threaded configurations for accomplishing said locking.

9. The assembly of claim 7, wherein:

said sub covers said second ring and is drawn into engagement with it as said first ring is rotated.

10. The assembly of claim 9, wherein:

said second ring is split to facilitate mounting it to said mandrel;

said second ring and said mandrel further comprising facing threaded configurations for accomplishing said locking.

11. The assembly of claim 10, further comprising:

a carrier mounted to a bore of said mandrel defining at least one protected passage for the conduit through said mandrel bore.

12. The assembly of claim 6, wherein:

said sub is splined to said mandrel for torque transmission therebetween.

13. The assembly of claim 12, wherein said travel stop further comprises:

a second ring mounted over said mandrel, said second ring having an internal surface to engage an exterior surface of said mandrel for longitudinal locking engagement.

14. The assembly of claim 13, further comprising:

a carrier mounted to a bore of said mandrel defining at least one protected passage for the conduit through said mandrel bore.

15. The assembly of claim 14, further comprising:

a top and a bottom sub, connectible in an identical manner to opposed ends of said mandrel and being identically configured, with at least one passage so that a conduit can be inserted and sealed through said passages and extend through said protected passage in said carrier.

16. A downhole tool assembly capable of passing at least one conduit therethrough, comprising:

a mandrel at least one sub sealingly connectible to said mandrel having at least one passage therethrough:

a sealing member disposed in said passage for sealing the conduit passing through said passage;

said sub is securable to said mandrel without rotation of said sub;

said sub is engageable to said mandrel in a manner to prevent relative rotation;

a carrier mounted to a bore of said mandrel defining at least one protected passage for the conduit through said mandrel bore.

17. A method of passing a conduit through a mandrel having a bore in a downhole tool, comprising:

passing a conduit through a passage on at least one sub;

sealingly connecting said sub to the mandrel without rotating said sub;

sealing around said conduit as it passes through the passage on said sub and thereafter through said bore.

18. A method of passing a conduit through a mandrel in a downhole tool, comprising:

passing a conduit through a passage on at least one sub;

sealingly connecting said sub to the mandrel without rotating said sub;

sealing around said conduit as it passes through the passage on said sub and said bore;

rotationally locking said sub to said mandrel;

allowing said sub to move longitudinally for said sealingly connecting.

19. The method of claim 18, further comprising:

providing a travel stop on said mandrel;

drawing said sub into said travel stop to secure said sub to said mandrel for transmission of longitudinal forces.

20. The method of claim 19, further comprising:

providing a carrier in the bore of said mandrel which defines at least one protected passage for said conduit;

running said conduit from said passage in said sub through said protected passage.

21. The method of claim 20, further comprising:

assembling a split ring over said mandrel to act as said travel stop;

providing interlocking surfaces on said mandrel and said split ring;

covering said split ring with said sub to secure it to said mandrel;

rotating a lock ring on said mandrel to draw said sub to said travel stop;

using splines to rotationally lock said sub to said mandrel.

* * * * *